US008485636B2

(12) United States Patent
Shindo et al.

(10) Patent No.: US 8,485,636 B2
(45) Date of Patent: Jul. 16, 2013

(54) MAINTENANCE METHOD FOR LIQUID JETTING APPARATUS AND LIQUID JETTING APPARATUS

(75) Inventors: Tatsuya Shindo, Nagoya (JP); Katsunori Nishida, Aichi-ken (JP)

(73) Assignee: Brother Kogyo Kabushiki Kaisha, Nagoyai-shi, Aichi-Ken (JP)

( * ) Notice: Subject to any disclaimer, the term of this patent is extended or adjusted under 35 U.S.C. 154(b) by 181 days.

(21) Appl. No.: 12/871,330

(22) Filed: Aug. 30, 2010

(65) Prior Publication Data

US 2011/0050798 A1 Mar. 3, 2011

(30) Foreign Application Priority Data

Aug. 31, 2009 (JP) ..... 2009-199975

(51) Int. Cl.
*B41J 2/165* (2006.01)

(52) U.S. Cl.
USPC ..... 347/30; 347/22; 347/29

(58) Field of Classification Search
None
See application file for complete search history.

(56) References Cited

U.S. PATENT DOCUMENTS

2002/0054184 A1 5/2002 Kan
2002/0097292 A1 * 7/2002 Saijo et al. ..... 347/30
2007/0119983 A1 5/2007 Suzuki et al.
2007/0182779 A1 * 8/2007 Iwasaki ..... 347/30
2007/0296754 A1 12/2007 Hiraki et al.
2009/0015643 A1 1/2009 Hosono

FOREIGN PATENT DOCUMENTS

JP 09-262991 A 10/1997
JP 2002-127453 A 5/2002
JP 2007-118526 A 5/2007
JP 2007-331269 12/2007
JP 2009-18447 1/2009

OTHER PUBLICATIONS

Notice of Reasons for Rejection (Office Action) of Japanese Patent Application No. 2009-199975 with partial English translation.

* cited by examiner

*Primary Examiner* — Matthew Luu
*Assistant Examiner* — Justin Seo
(74) *Attorney, Agent, or Firm* — Scully, Scott, Murphy & Presser PC

(57) ABSTRACT

A maintenance method for a liquid jetting apparatus provided with a jetting head which has a nozzle surface formed with nozzle holes and which discharges a liquid from the nozzle holes, and a cap which covers the nozzle surface includes discharging the liquid in the jetting head from the nozzle holes into the cap in a state that the nozzle surface of the jetting head is covered with the cap; and sucking the liquid discharged into the cap via a discharge hole provided at a bottom portion of the cap in a state that the cap is separated from the jetting head; and the liquid, which is discharged into the cap, is sucked in first and second suction modes in which suction amounts per a predetermined period of time are different from each other.

20 Claims, 12 Drawing Sheets

MAINTENANCE METHOD FOR LIQUID JETTING APPARATUS AND LIQUID JETTING APPARATUS

CROSS REFERENCE TO RELATED APPLICATION

The present application claims priority from Japanese Patent Application No. 2009-199975 filed on Aug. 31, 2009, the disclosures of which are incorporated herein by reference in their entirety.

BACKGROUND OF THE INVENTION

1. Field of the Invention

The present invention relates to a maintenance method for a liquid jetting apparatus, in particular, an idle suction method for sucking and discharging a liquid accumulated in a cap after performing a purge by covering a jetting head provided for a liquid jetting apparatus with the cap, and the liquid jetting apparatus.

2. Description of the Related Art

In the conventional liquid jetting apparatus exemplified by a printer apparatus based on the ink-jet system, for example, a plurality of nozzle holes are formed on a nozzle surface of a jetting head, and a liquid such as an ink or the like is jetted from the nozzle holes. When the liquid jetting apparatus is used after a long period of time in which the liquid jetting apparatus is not used, the purge process is performed to suck out the remaining liquid by a suction pump in order to discard any deteriorated liquid remaining in the nozzle holes of the jetting head.

In order to perform the purge process, for example, the conventional ink-jet printer is provided with a cap for covering the nozzle surface. Further, a discharge hole, which is formed at a bottom portion of the cap, is connected to the suction pump via an ink flow passage. The suction pump is driven to generate the negative pressure in the cap in a state that the nozzle surface is covered with the cap so that the nozzle holes are surrounded inside. Accordingly, the purge process is performed, in which the liquid in the nozzle holes is sucked out into the cap.

If the liquid, which is accumulated in the cap by the purge process, is remained as it is, the liquid-accommodating capacity in the cap is lowered when the next purge process is performed. Further, the discharge hole formed at the bottom portion of the cap and the ink flow passage may be clogged up. A possibility arises such that the purge process cannot be executed appropriately in the next time and the followings. Therefore, in the conventional ink-jet printer, the suction pump is driven (to perform the idle suction) in a state that the cap is separated from the nozzle surface after completing the purge process, and thus the liquid, which is accumulated in the cap, is discharged to the outside of the cap via a tube.

When the idle suction is executed, if the suction speed (i.e., the pump suction amount per unit time) is not appropriate, then the opening, which is communicated with the discharge hole, is formed at the liquid surface of the liquid accumulated on the inner bottom portion of the cap in some cases.

If such an opening is formed, even when the suction pump is driven to perform the idle suction, then only the air is sucked through the opening. Once the suction of the air starts through the opening, the movement of the surrounding liquid, which is to be brought about in the direction to close the opening, is inhibited by the flow of the air. As a result, the opening is hardly closed. Therefore, the period of time, in which only the air is sucked, is prolonged, and it is difficult to efficiently discharge the liquid contained in the cap.

It is considered that such a phenomenon results from the viscosity (fluidity) of the liquid and the suction speed of the pump. The liquid jetting apparatus is used in a variety of temperature environments. The liquid jetting apparatus is used in a relatively low temperature environment in some cases, and the liquid jetting apparatus is used in a relatively high temperature environment in other cases. The viscosity of the liquid (especially the ink) is changed depending on the temperature environment in which the liquid jetting apparatus is used. Therefore, if the suction speed during the idle suction is constant, for example, when the liquid jetting apparatus is used in a low temperature environment in which the viscosity of the liquid is high, then a possibility arises such that the idle suction cannot be performed appropriately. It is affirmed that such a circumstance also arises similarly in any liquid jetting apparatus for jetting any other liquid, without being limited to the printer apparatus for jetting the ink.

SUMMARY OF THE INVENTION

In view of the above, an object of the present invention is to provide a maintenance method for a liquid jetting apparatus, in particular, an idle suction method for the liquid jetting apparatus and the liquid jetting apparatus in which the idle suction can be appropriately performed after the purge irrelevant to any change of the environmental temperature.

According to a first aspect of the present invention, there is provided a maintenance method for a liquid jetting apparatus provided with a jetting head which has a nozzle surface formed with nozzle holes and which jets a liquid from the nozzle holes, and a cap which covers the nozzle surface; the maintenance method including: discharging the liquid in the jetting head from the nozzle holes into the cap in a state that the nozzle surface of the jetting head is covered with the cap; and sucking the liquid discharged into the cap via a discharge hole provided at a bottom portion of the cap in a state that the cap is separated from the jetting head, and the liquid, which is discharged into the cap, is sucked in first and second suction modes in which suction amounts per a predetermined period of time are different from each other.

According to a second aspect of the present invention, there is provided a liquid jetting apparatus which jets a liquid; including: a jetting head which has a nozzle surface formed with a plurality of nozzle holes and which jets the liquid from the nozzle holes; a cap which has a bottom portion formed with a discharge hole and which covers the nozzle surface of the jetting head; a sucking mechanism which sucks the liquid in the cap via the discharge hole; a moving mechanism which moves the cap between a capping position at which the cap covers the nozzle holes and a retracted position at which the cap is separated from the jetting head; and a controller which controls the jetting head, the sucking mechanism, and the moving mechanism, and the controller controls the moving mechanism to move the cap to the capping position; controls one of the jetting head and the sucking mechanism to discharge the liquid in the jetting head from the nozzle holes into the cap; controls the moving mechanism to move the cap to the retracted position; and controls the sucking mechanism to suck the liquid discharged into the cap via the discharge hole; and the controller drives the sucking mechanism in a first suction mode, and then the controller drives the sucking mechanism in a second suction mode in which a suction amount for sucking the liquid in the cap per a predetermined period of time is different from that in the first suction mode.

According to the first and second aspects of the present invention, the suction in the first suction mode and the suction in the second suction mode are executed in a blended or mixed manner when the liquid, which is discharged into the cap, is sucked. Therefore, even when the opening, which is communicated with the discharge hole, is formed at the liquid surface of the liquid in the cap, for example, on account of high speed suction in the first suction mode, the movement of the liquid can be induced to close the opening during low speed suction in the second suction mode. It is possible to efficiently discharge the liquid accumulated in the cap. In the following description, the suction, which is performed to suck the liquid discharged into the cap by driving the sucking mechanism connected to the cap in the state that the cap is separated from the nozzle surface of the jetting head, is referred to as "idle suction".

BRIEF DESCRIPTION OF THE DRAWINGS

FIG. 3 shows flow charts illustrating the idle suction process to be performed by the printer apparatus.

FIG. 4 schematically shows states during the idle suction for the ink in a cap.

FIG. 8 shows an embodiment in which a cap is released downwardly from a state shown in FIG. 7.

DESCRIPTION OF THE PREFERRED EMBODIMENTS

An explanation will be made below with reference to the drawings about a liquid jetting apparatus and a maintenance method, in particular, an idle suction method after a purge according to an embodiment of the present invention, as exemplified by an exemplary case in which the present invention is applied to a printer apparatus based on the ink-jet system (hereinafter referred to as "printer apparatus") as an example of the liquid jetting apparatus.

Figure 1:
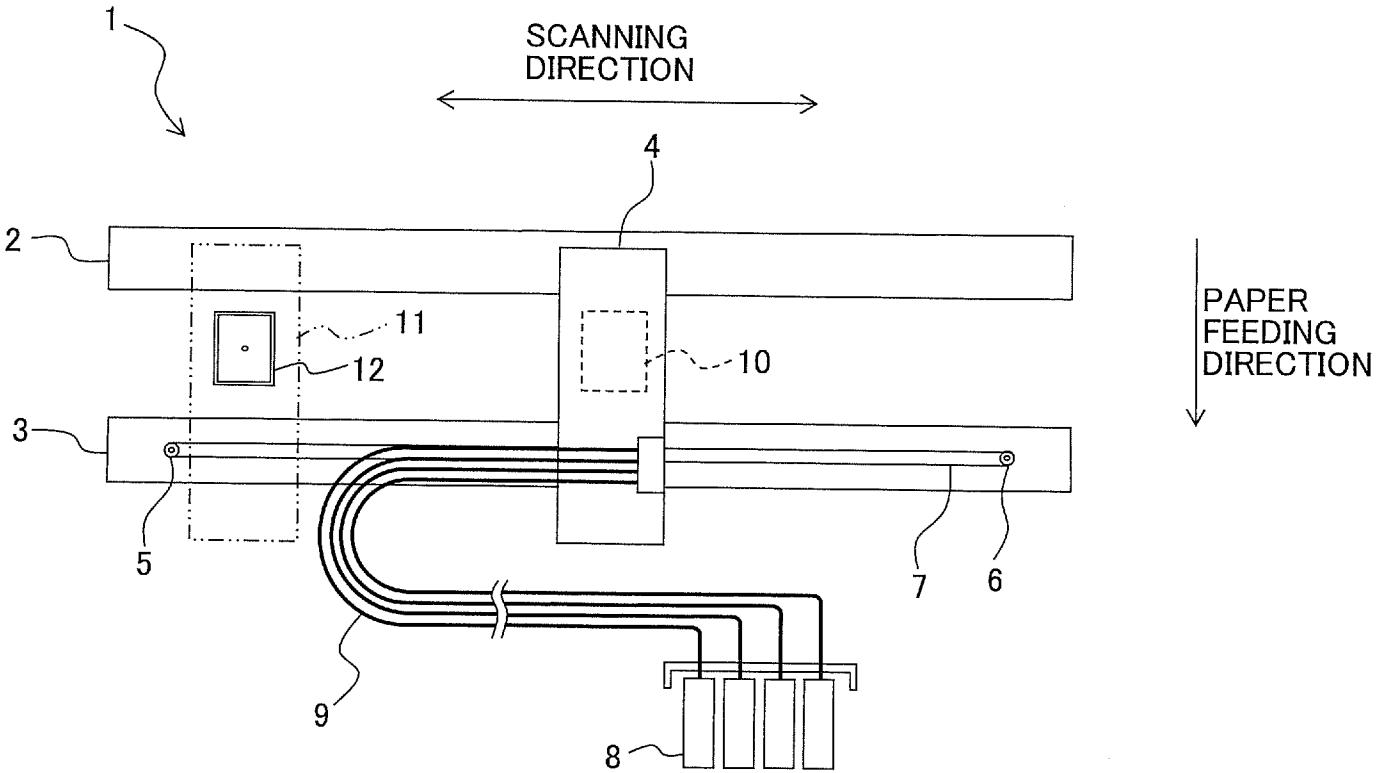
FIG. 1 shows a schematic plan view illustrating main components of a printer apparatus as a liquid jetting apparatus.

At first, an overall arrangement of the printer apparatus 1 will be explained. As shown in FIG. 1, a pair of guide rails 2, 3, which extend in the left-right direction, are arranged substantially in parallel for the printer apparatus 1. A liquid supply unit 4 is supported by the guide rails 2, 3 so that the liquid supply unit 4 is slidable in a scanning direction (left-right direction in FIG. 1). A pair of pulleys 5, 6 are provided in the vicinity of left and right end portions of the guide rail 3. The liquid supply unit 4 is joined to a timing belt 7 applied and wound around the pulleys 5, 6. A motor (not shown), which is driven and rotated in the positive or negative (clockwise or counterclockwise) direction, is provided for the one pulley 6. When the pulley 6 is driven and rotated in the positive or negative direction, the timing belt 7 is reciprocatively moved in the leftward direction or the rightward direction. Accordingly, the liquid supply unit 4 is reciprocatively scanned in the left-right direction along with the guide rails 2, 3.

Four ink cartridges 8 are attached to the printer apparatus 1 so that the four ink cartridges 8 are detachable for the exchange. Four flexible ink supply tubes 9 are connected to the liquid supply unit 4 in order to supply four color inks (for example, black, cyan, magenta, and yellow) from the ink cartridges 8 respectively. A jetting head 10 (see FIG. 2), which has a rectangular shape as viewed in a plan view, is carried under or below the liquid supply unit 4. The inks (liquids) are jetted from the jetting head 10 toward a recording medium (for example, recording paper) which is transported in the direction (paper feeding direction) perpendicular to the scanning direction thereunder or therebelow. Thus, an image is formed on the recording medium.

The maintenance position 11 (position indicated by two-dot chain lines in FIG. 1) is provided at one end of the scanning range of the liquid supply unit 4. A cap 12, which is used when the purge process is performed, is arranged thereunder or therebelow. For example, when the printer apparatus 1 is used again after a long period of time in which the printer apparatus 1 is not used, for example, the purge process is executed for the liquid supply unit 4 at the maintenance position 11.

Figure 2:
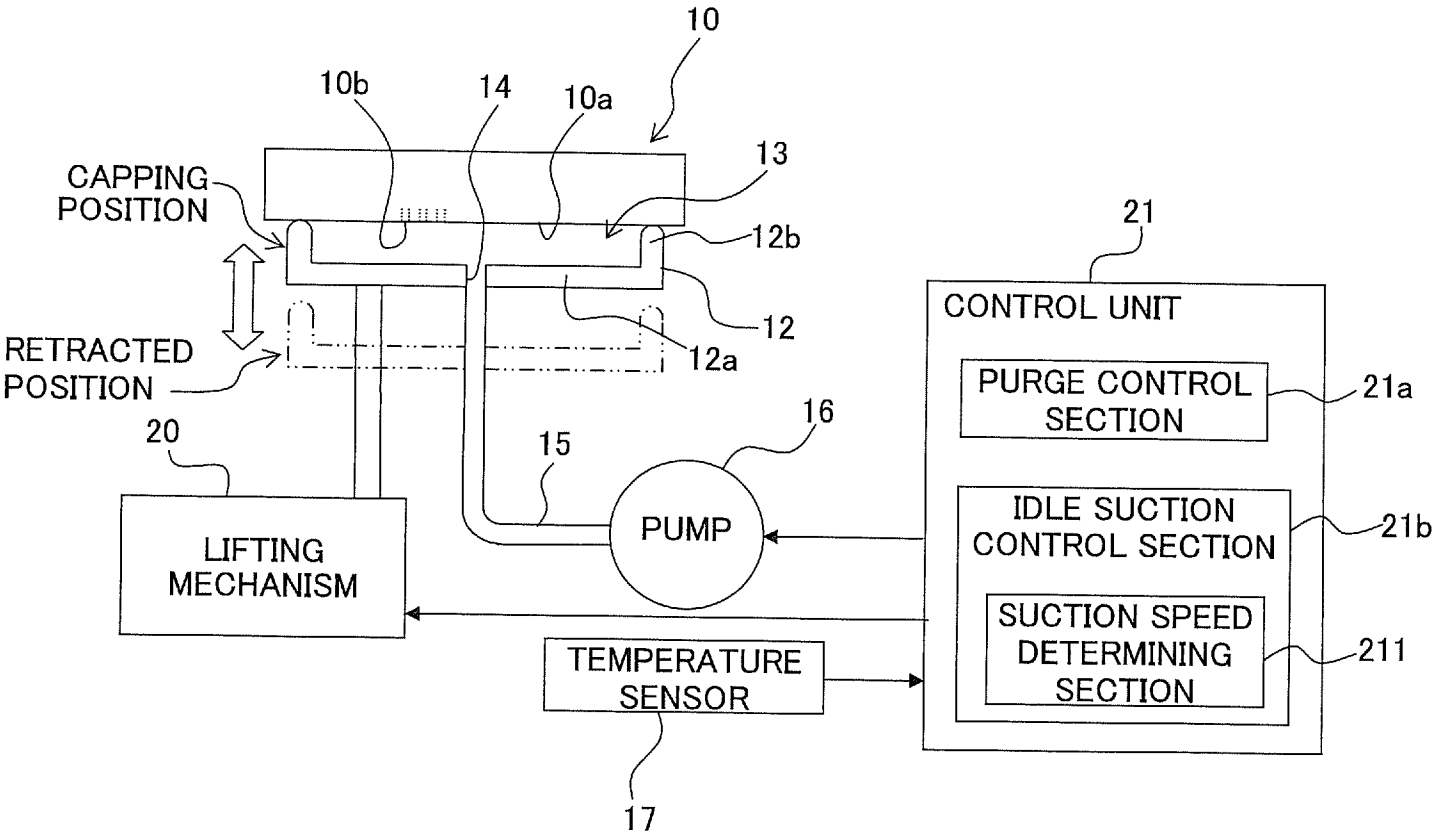
FIG. 2 schematically shows an arrangement in relation to the maintenance for the printer apparatus.

Next, an explanation will be made about an arrangement in relation to the maintenance for the printer apparatus 1. As shown in FIG. 2, the printer apparatus 1 is provided with the cap 12 which is provided under or below the jetting head 10 at the maintenance position 11. The cap 12 has a rectangular shape which is one size smaller than the jetting head 10 as viewed in a plan view. A circumferential wall portion 12*b* is provided upstandingly from four sides of an inner bottom portion 12*a*. The internal space, which is surrounded by the inner bottom portion 12*a* and the circumferential wall portion 12*b*, is the liquid storage space 13.

A lifting mechanism (moving mechanism) 20 is connected to the cap 12. The cap 12 is movable upwardly and downwardly between the upper position (capping position) at which the upper end portion of the circumferential wall portion 12*b* abuts against the nozzle surface 10*a* disposed on the lower surface of the jetting head 10 and the lower position (retracted position) at which the cap 12 is separated from the nozzle surface 10*a*. When the cap 12 abuts against the nozzle surface 10*a* at the upper position, the plurality of nozzle holes 10*b*, which are formed on the nozzle surface 10*a* for jetting the liquids, are in such a state that the plurality of nozzle holes 10*b* are surrounded inside by the cap 12 while being surrounded by the circumferential wall portion 12*b* (in a state that the plurality of nozzle holes 10*b* are open toward the liquid storage space 13).

A discharge hole 14, which penetrates through the inner bottom portion 12*a*, is fowled for the inner bottom portion 12*a* of the cap 12. One end of a flexible suction tube 15 is connected to the discharge hole 14, and a suction pump (sucking mechanism) 16 is connected to the other end. Therefore, when the suction pump 16 is driven, it is possible to generate the negative pressure in the liquid storage space 13 of the cap 12 by the aid of the suction tube 15. Any suction pump can be appropriately selected as the suction pump 16 provided that the suction speed (pump suction amount per unit time) is changeable. In this embodiment, a known tube pump is adopted.

The tube pump includes a rotor (not shown) which has pressing (pressurizing) elements at circumferential portions, and a motor (not shown) which drives and rotates the rotor. One end of the suction tube 15 is connected to the cap 12, and the other end is connected to a waste liquid foam (not shown) via the tube pump. The local pressing portion of the suction tube 15, which is pressed by the pressing element, is moved in accordance with the rotation of the rotor. Accordingly, the ink in the suction tube 15 can be sucked toward the tube pump. Owing to the arrangement as described above, the tube pump can prohibit the movement of the ink in the suction tube 15 as well when the operation is not performed. Any counterflow of the ink toward the cap 12 is avoided.

On the other hand, as shown in FIG. 2, the printer apparatus 1 is provided with a control unit 21 (controller). The control unit 21 includes unillustrated MPU (Micro Processing Unit), ROM (Read Only Memory) composed of, for example, PROM (Programmable Read-Only Memory) or mask ROM, and RAM (Random Access Memory). The suction pump 16, a temperature sensor 17 for detecting the environmental temperature in the vicinity of the jetting head 10, and the lifting mechanism 20 are connected to the control unit 21. At least the data and the program required to execute the maintenance operation including the idle suction operation described in this embodiment are recorded in ROM. The information in relation to the temperature detected by the temperature sensor 17 is temporarily recorded in RAM. MPU executes the predetermined program recorded in ROM with reference to the information recorded in RAM and the data recorded in ROM. Accordingly, the purge process and the idle suction process are executed as described later on. The control unit 21 includes a purge control section 21*a* and an idle suction control section 21*b*. The idle suction control section 21*b* includes a suction speed determining section 211. The control unit 21 also controls the lifting mechanism 20 described above to move the cap 12 upwardly and downwardly between the capping position and the retracted position. The temperature sensor 17 is provided in the printer apparatus 1 to detect the temperature in the printer apparatus 1. The temperature sensor 17 may be provided, for example, around the jetting head 10 to detect the temperature around the jetting head 10. Alternatively, the temperature sensor 17 may be provided around the cap 12 or the suction tube 15 to detect the temperature around the cap 12 or the suction tube 15.

Figure 3B:
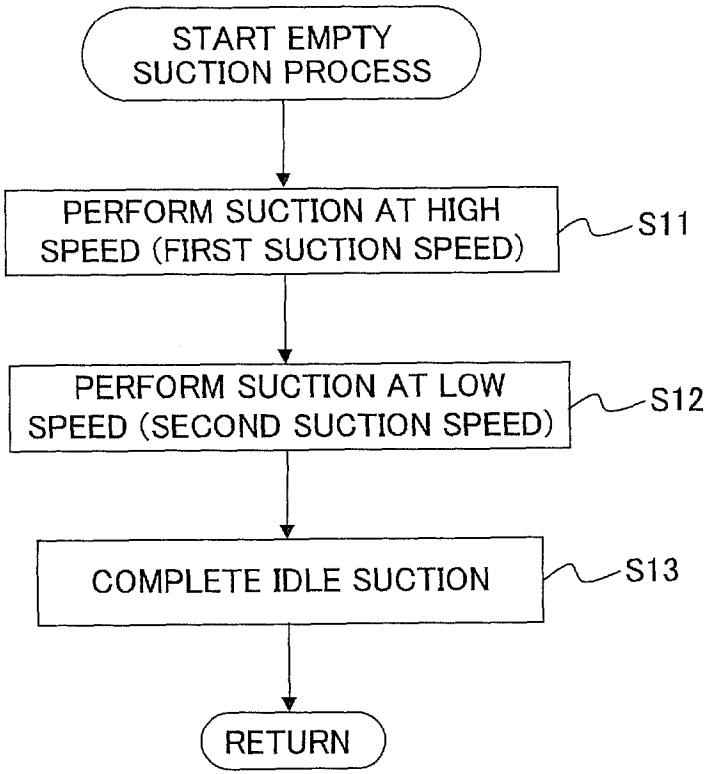
FIG. 3B shows the idle suction process.
Figure 3A:
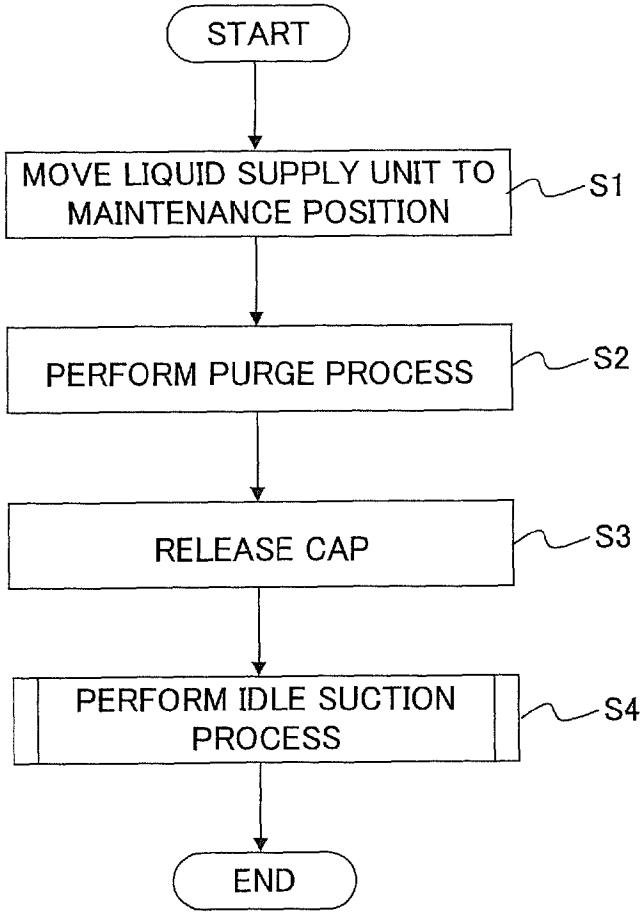
FIG. 3A shows an example of the maintenance process including the idle suction process.

Next, the idle suction operation of this embodiment will be explained. As shown in FIG. 3A, when the maintenance including the idle suction process is executed, the liquid supply unit 4 is firstly moved to the maintenance position (Step S1). Subsequently, the control unit 21 drives the lifting mechanism 20 to move the cap 12 upwardly to the upper capping position so that the nozzle surface 10*a* of the jetting head 10 is covered with the cap 12. In this state, the purge control section 21*a* controls the suction pump 16 so that the suction pump 16 is driven at a predetermined speed in a predetermined amount to perform the purge process (Step S2). According to this process, a predetermined amount of the ink is discharged to the liquid storage space 13 of the cap 12. When the purge process is completed, the control unit 21 drives the lifting mechanism 20 again to move the cap 12 downwardly. Accordingly, the cap 12 is released from the nozzle surface 10*a*, and the cap 12 is moved to the retracted position which is separated from the nozzle surface 10*a* by the predetermined distance (Step S3).

Subsequently, at the retracted position, the idle suction control section 21*b* drives the suction pump 16 to execute the idle suction process (Step S4). As shown in FIG. 3B, in the idle suction process, the suction pump 16 is firstly driven at the first suction speed (Step S11), and then the suction pump 16 is driven at the second suction speed which is different from the first suction speed (Step S12). In other words, the suction pump 16 is driven in the first and second suction modes in which the suction amounts per a predetermined period of time are different from each other. More specifically, in Step S11, the suction pump 16 is driven at the first suction speed. Subsequently, in Step S12, the suction pump 16 is driven at the second suction speed which is lower than the first suction speed. The suction pump 16 is stopped at a point in time at which a predetermined total suction volume is completely sucked to complete the idle suction process (Step S13).

When the idle suction operation is executed as described above, the ink, which is accumulated in the cap 12 after the purge, can be reliably sucked and discharged from the discharge hole 14.

Figure 4B:
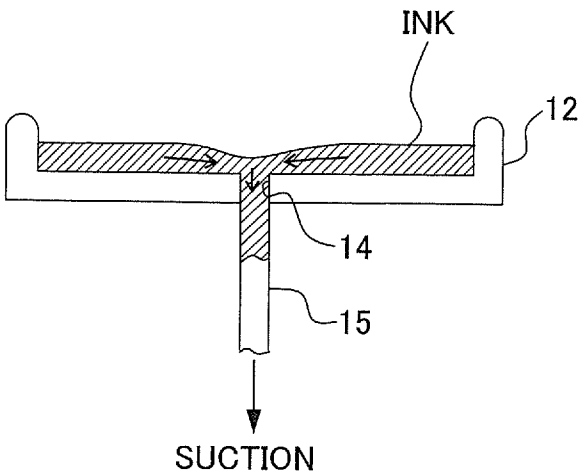
FIG. 4B shows Working Example in which the operation is executed according to an embodiment of the present invention.
Figure 4A:
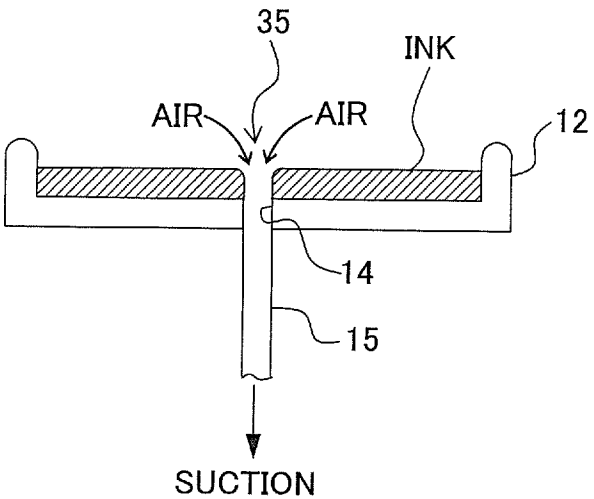
FIG. 4A shows Comparative Example in which the idle suction is performed at a relatively high speed irrelevant to the environmental temperature.

As shown in FIG. 4A, when the suction pump 16 is driven at a constant high speed to perform the idle suction, then the opening 35 is formed at the liquid surface just over the discharge hole 14, and the state is given, in which the opening 35 and the discharge hole 14 are communicated with each other. In this situation, even when the suction pump 16 is further driven at the constant speed, then the air, which has the small suction resistance, is consequently sucked into the discharge hole 14 through the opening 35, and the surrounding ink is hardly sucked. On the contrary, in the case of the embodiment of the present invention as shown in FIG. 4B, the idle suction is firstly performed at the high speed, and then the idle suction is performed at the low speed. Therefore, the opening 35, which is communicated with the discharge hole 14, is not formed at the liquid surface. In another situation, even when the opening 35 is formed during the idle suction at the high speed, the opening 35 can be closed during the idle suction at the low speed. Therefore, it is possible to suppress the suction of the air into the discharge hole 14. The ink in the cap 12 is efficiently moved toward the discharge hole 14, and the ink is efficiently sucked.

The process, which is to be executed by the suction speed determining section 211 for changing the driving of the suction pump 16 from the driving at the first suction speed to the driving at the second suction speed, may be performed, for example, such that the data, which indicates the first suction speed and the driving time thereof and the second suction speed and the driving time thereof, is previously stored in ROM, and the suction pump 16 is driven based on the data read in the idle suction process. In general, it is preferable that the period of time, in which the driving is performed at the first suction speed, is set to be shorter than the period of time in which the driving is performed at the second suction speed lower than the first suction speed. If the period of time, in which the suction is performed at the first suction speed, is set to be long, a high possibility arises such that the opening 35, which is communicated with the discharge hole 14, may be formed at the liquid surface. Therefore, the following procedure is preferred. That is, the suction is performed at the first suction speed, then the speed is switched to the second suction speed when the ink in the cap 12 is decreased to some extent, and the suction is performed for a long period of time so that the opening 35 is not formed. For example, when about 0.3 ml of the ink in the cap 12 is sucked, then the first suction speed is set to about 0.1088 ml/s, and the second suction speed is set to about 0.093 ml/s. The driving is performed for about 1 second at the first suction speed, and then the driving is performed for about 2 seconds at the second suction speed. Accordingly, the ink in the cap 12 is successfully sucked without forming the opening 35 at the liquid surface in the cap 12. However, the first and second suction speeds described above are referred to merely as examples. The second suction speed may have such a magnitude that the second suction speed is about a half of the first suction speed. In this embodiment, the period of time, which is required to suck all of the ink in the cap, is prolonged in some cases as compared with a case in which the suction is continuously performed at the first suction speed, depending on the setting of the period of time in which the driving is performed at the first suction speed and the period of time in which the driving is performed at the second suction speed. However, the idle suction operation is the operation which can be executed irrelevant to the printing operation. The idle suction operation does not exert any influence on the printing time. Therefore, in view of the fact that the ink in the cap can be reliably sucked, it is affirmed that the embodiment of the present invention is more excellent than any sucking method in which the suction is continuously performed at a constant suction speed. It is also allowable that the suction speed determining section 211 performs the process by any other method. For example, it is also appropriate that the data, which indicates the number of revolutions (angle of rotation) of the suction pump 16, is used in place of the driving time described above.

Next, an explanation will be made about other embodiments of the idle suction process capable of being executed in Step S4 shown in FIG. 3A.

Figure 5A:
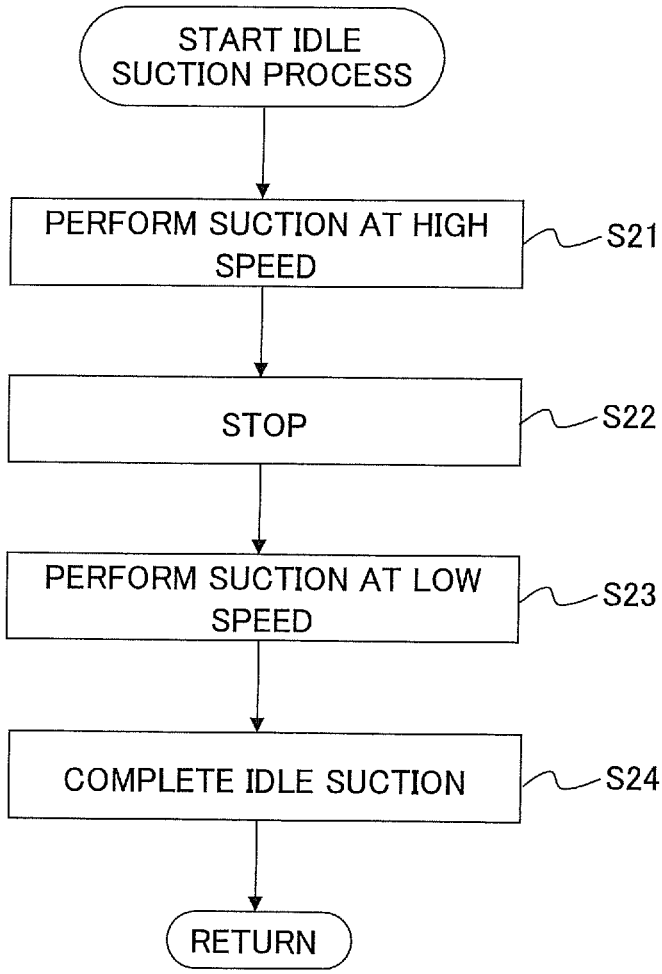
FIGS. 5A-5C show flow charts illustrating other embodiments of the idle suction process which can be executed in Step S4 shown in FIG. 3A, respectively.

In an idle suction process shown in FIG. 5A, the idle suction at the high speed (Step S21) equivalent to Step S11 shown in FIG. 3B and the idle suction at the low speed (Step S23) equivalent to Step S12 are executed, and the idle suction is completed (Step S24). However, a process (Step S22), in which the suction pump 16 is stopped for several seconds, specifically for about 2 to 3 seconds, is allowed to intervene between the processes of Steps S21, S23. In this stopping process, the elapsed time is measured by an unillustrated timer. When a predetermined period of time elapses, the routine proceeds to the process of Step S23.

The stopping process includes an operation mode in which the driving of the suction pump 16 is completely stopped. Additionally, the stopping process also includes a driving operation at an extremely low speed in which the suction speed brought about by the suction pump 16 is substantially zero. In this embodiment, the term "substantially zero" means the suction speed which is not more than 10% of the suction speed provided when the idle suction is performed at the high speed. When the driving is transitioned from the high speed driving in Step S21 to the low speed driving in Step S23, a temporary stopped state (stop state), which is inevitable, for example, due to the structural factor of the suction pump 16, arises in some cases. However, such a stopped state is not included in the stopping process intended in Step S22.

When the idle suction operation is executed as described above, the ink, which is accumulated in the cap 12 after the purge, can be reliably sucked and discharged from the discharge hole 14. That is, in the initial state in which a large amount of the ink is accumulated in the liquid storage space 13, the ink is efficiently sucked and discharged by the high speed idle suction in Step S21. Even when the opening 35 as shown in FIG. 4A is formed during this process, the opening 35 can be closed by the stopping process performed subsequently for the certain period of time in Step S22. Further, even in the case of such a state that the amount of the ink is small in the liquid storage space 13, the ink can be efficiently sucked and discharged so that the opening 35 is not formed, by the low speed idle suction performed subsequently in Step S23.

The processes of Steps S21 to S23 are realized by the suction speed determining section 211. For example, the data, which indicates the suction speed in the high speed operation, the driving time thereof, the period of time during the stop (stopping time), the suction speed in the low speed operation, and the driving time thereof, may be previously stored in ROM. The suction pump 16 may be driven based on the data read in the idle suction process. Alternatively, it is also appropriate that the data, which indicates the number of revolutions (angle of rotation) of the suction pump 16, is used in place of the driving time described above.

Figure 5B:
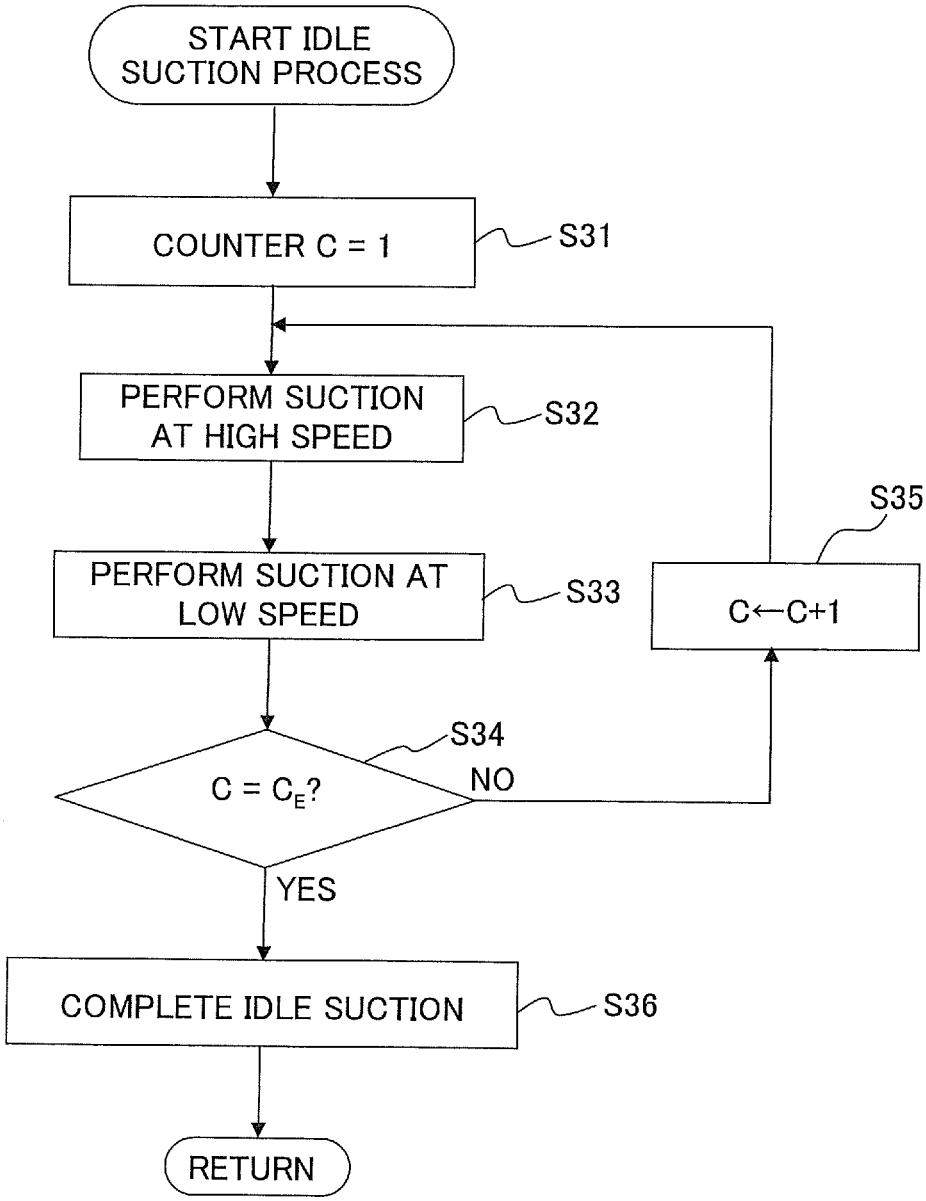

In an idle suction process shown in FIG. 5B, the idle suction at the high speed and the idle suction at the low speed, which have been already explained in FIG. 3B, are executed by repeating the operations a plurality of times. This feature will be specifically explained below. When the idle suction process (Step S4, see FIG. 3A) is started, then an unillustrated counter is started, and C=1 is set as the initial value (Step S31). Subsequently, the idle suction at the high speed (Step S32) and the idle suction at the low speed (Step S33) are successively executed in the same manner as in Steps S11, S12 shown in FIG. 3B. After that, it is judged whether or not the counted value C is coincident with a predetermined end value (terminating value) $C_E$ (for example, $C_E$=3) (Step S34). If the counted value C is not coincident with the end value $C_E$ (Step S34: NO), a new counted value C, which is obtained by adding 1 to the counted value C, is provided (Step S35). After that, the processes starting from Step S32 are executed again. On the other hand, if the counted value C is coincident with the end value $C_E$ in Step S34 (Step S34: YES), the idle suction is completed (Step S36).

In the embodiment of the idle suction operation as described above, the ink is efficiently sucked and discharged by the idle suction at the high speed (Step S32). Even if the opening 35 is formed in this process, the opening 35 can be closed by the subsequent idle suction at the low speed (Step S33). Further, when the idle suction at the high speed (Step S32) is executed again in the state that the opening 35 is closed, it is possible to efficiently suck and discharge the remaining ink again. In this way, the ink can be quickly sucked and discharged while closing the opening 35 by repeating the idle suction at the high speed and the idle suction at the low speed.

As for the counter described above, a counter program may be stored beforehand in ROM of the control unit 21, and the program may be executed by MPU. When the suction pump 16 is repeatedly driven at the high speed and the low speed, the process may be realized by any other method without being limited to the method in which the counter is used. For example, the data, in which the suction speed in the high speed operation and the driving time thereof and the suction speed in the low speed operation and the driving time thereof are repeatedly described a predetermined number of times, may be previously stored in ROM, and the suction pump 16 may be driven based on the data read in the idle suction process. Alternatively, it is also appropriate that the data, which indicates the number of revolutions (angle of rotation) of the suction pump 16, is used in place of the driving time described above. The method for realizing the process in relation to the repetition as described above is also adopted equivalently in any other embodiment of the idle suction operation explained below.

Figure 5C:
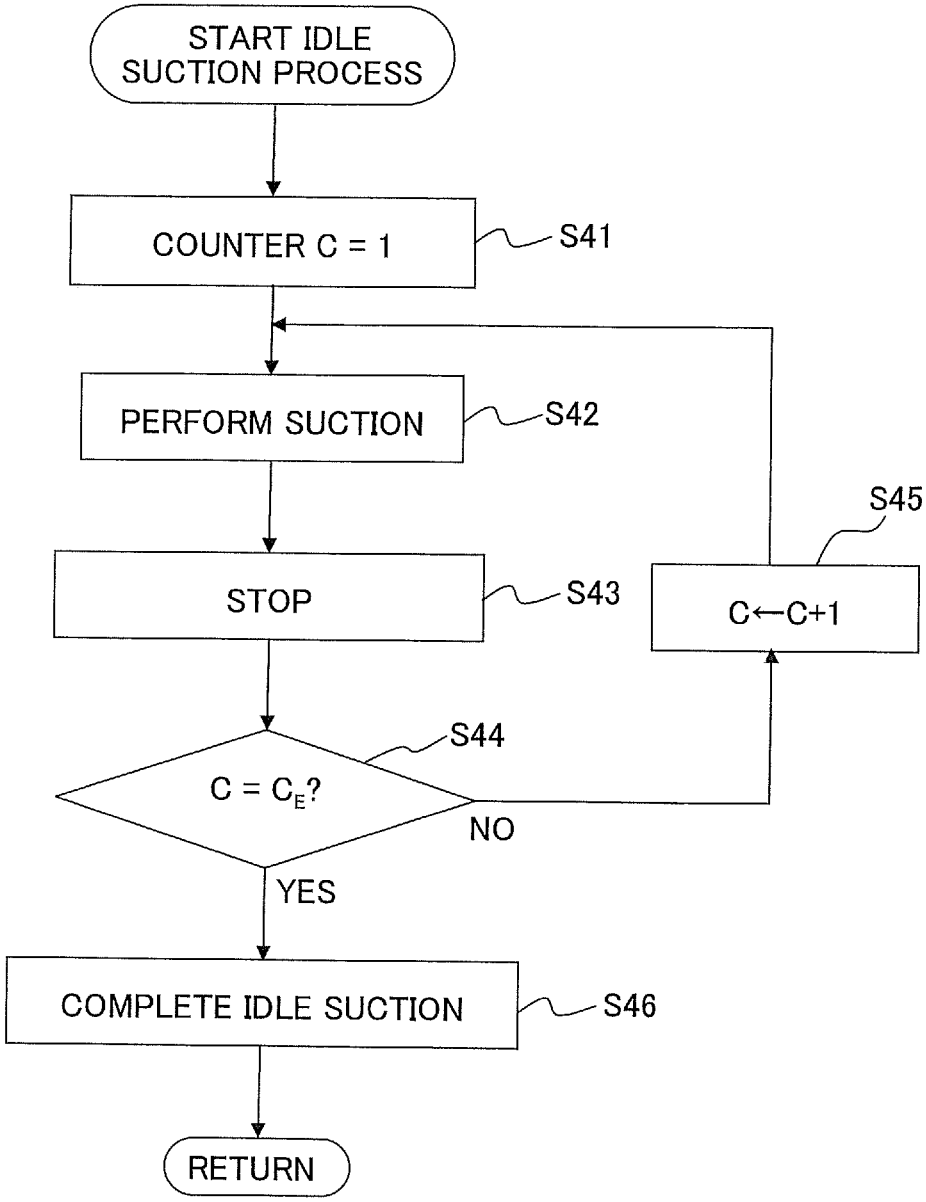

An idle suction process shown in FIG. 5C includes Steps S41 to S46 corresponding to the processes of Steps S31 to S36 shown in FIG. 5B. However, among them, only the processes of Steps S42, S43 are different from those of Steps S32, S33 corresponding thereto. The same operations are executed in the other processes. Specifically, in the process in Step S42, the suction pump 16 is driven at the predetermined suction speed (first suction speed). However, in the next step of Step S43, the suction pump 16 is in the stopped state. The suction process (Step S42) and the stopping process (Step S43) as described above are executed and repeated a predetermined number of times (Steps S44, S45). After that, the idle suction is completed (Step S46).

The stopping process in Step 43 is the same as or equivalent to the stopping process in Step S22 shown in FIG. 5A. The operation mode, in which the driving of the suction pump 16 is completely stopped, is included in the stopping process. Additionally, the stopping process also includes the driving at an extremely low speed in which the suction speed brought about by the suction pump 16 is substantially zero.

In the embodiment of the idle suction operation as described above, the ink can be efficiently sucked and discharged in the idle suction (Step S42). Even when the opening 35 is formed during this process, the opening 35 can be closed in the subsequent stopping process (Step S43). Further, the remaining ink can be efficiently sucked and discharged again by executing the idle suction (Step S42) again in the state that the opening 35 is closed. The ink can be quickly sucked and discharged while closing the opening 35 by repeating the suction operation and the stopped state as described above.

Figure 6A:
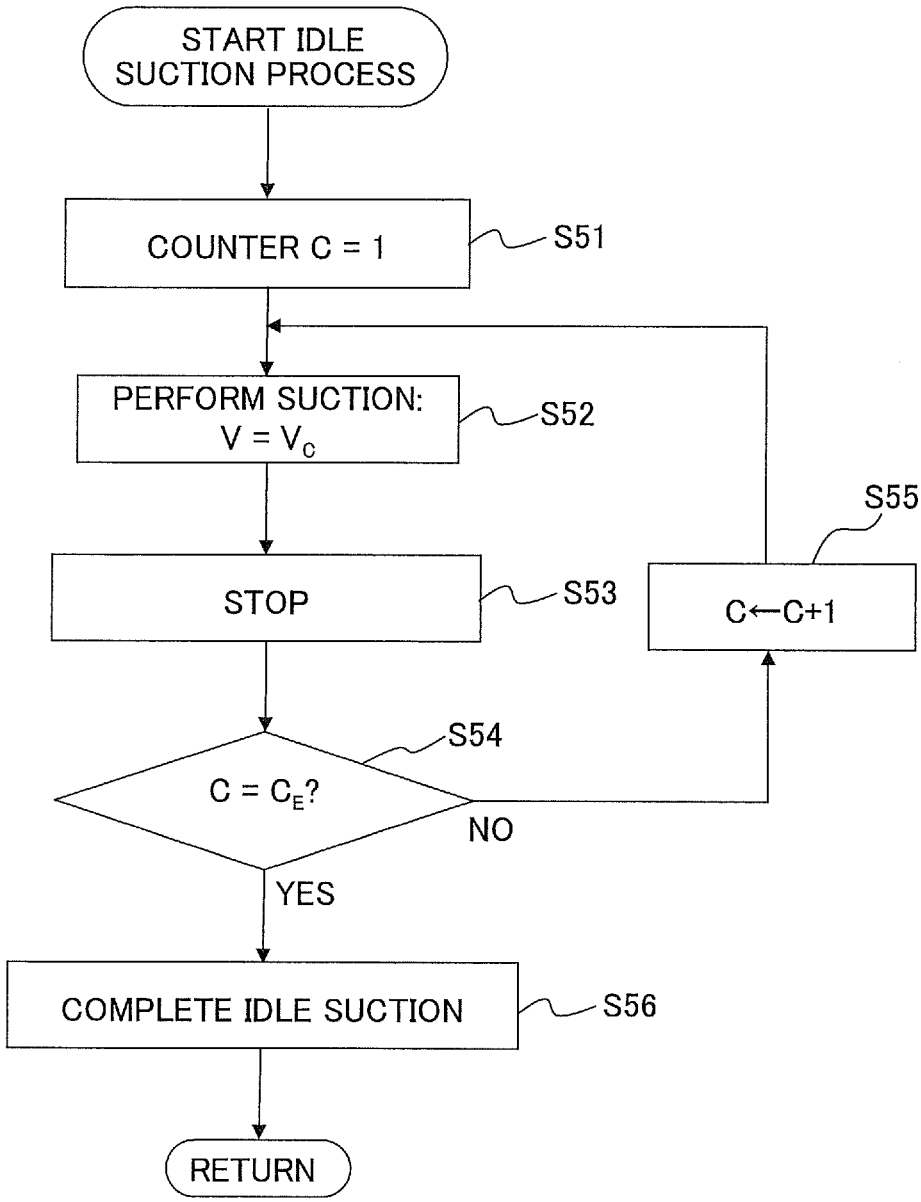
FIGS. 6A-6C show flow charts further illustrating other embodiments of the idle suction process which can be executed in Step S4 shown in FIG. 3A, respectively.

In an idle suction process shown in FIG. 6A, the processes of Steps S51 to S56, which are the same as or equivalent to those of Steps S41 to S46 shown in FIG. 5C, are performed. However, in the suction process in Step S52, the suction speed V is more lowered as the processes of Steps S52, S53 are repeated. For example, it is assumed that V1 represents the suction speed in Step S52 provided for the first time (C=1), V2 represents the suction speed provided for the second time (C=2), and V3 represents the suction speed provided for the third time (C=3). On this assumption, the operation condition of the suction pump 16 is set so that V1>V2>V3 is given. The driving of the suction pump 16, which is performed at the suction speeds as described above, is realized by the suction speed determining section 211 of the control unit 21.

In the embodiment of the idle suction operation as described above, the suction speed is lowered depending on the remaining amount of the ink which is progressively decreased every time when the suction operation and the stopped state are repeated. Therefore, the opening 35 as shown in FIG. 4A is hardly formed. Therefore, it is possible to quickly suck and discharge the ink while suppressing the formation of the opening 35.

Figure 6B:
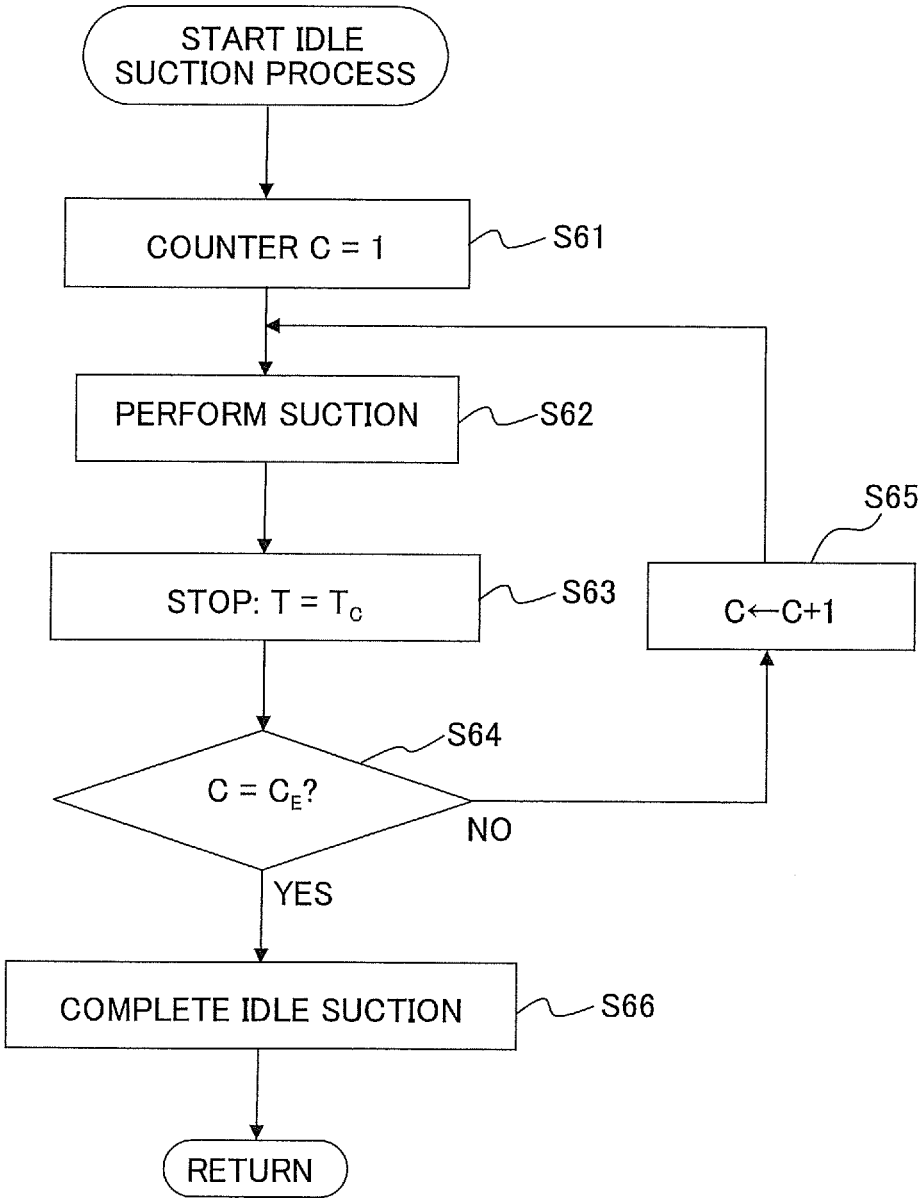

In an idle suction process shown in FIG. 6B, the processes of Steps S61 to S66, which are the same as or equivalent to those of Steps S41 to S46 shown in FIG. 5C, are performed. However, in the stopping process in Step S63, the stopping time T is more prolonged as the processes of Steps S62, S63 are repeated. For example, it is assumed that T1 represents the stopping time in Step S63 provided for the first time (C=1), T2 represents the stopping time provided for the second time (C=2), and T3 represents the stopping time provided for the third time (C=3). On this assumption, the operation condition of the suction pump 16 is set so that T1<T2<T3 is given. The driving of the suction pump 16 as described above is realized by the suction speed determining section 211 of the control unit 21.

In the embodiment of the idle suction operation as described above, the stopping time after the suction process is prolonged depending on the remaining amount of the ink which is progressively decreased every time when the suction operation and the stopped state are repeated. Therefore, even when the opening 35 as shown in FIG. 4A is formed, the opening 35 can be reliably closed during the stopping period provided once every time. Therefore, it is possible to quickly suck and discharge the ink while closing the opening 35.

Figure 6C:
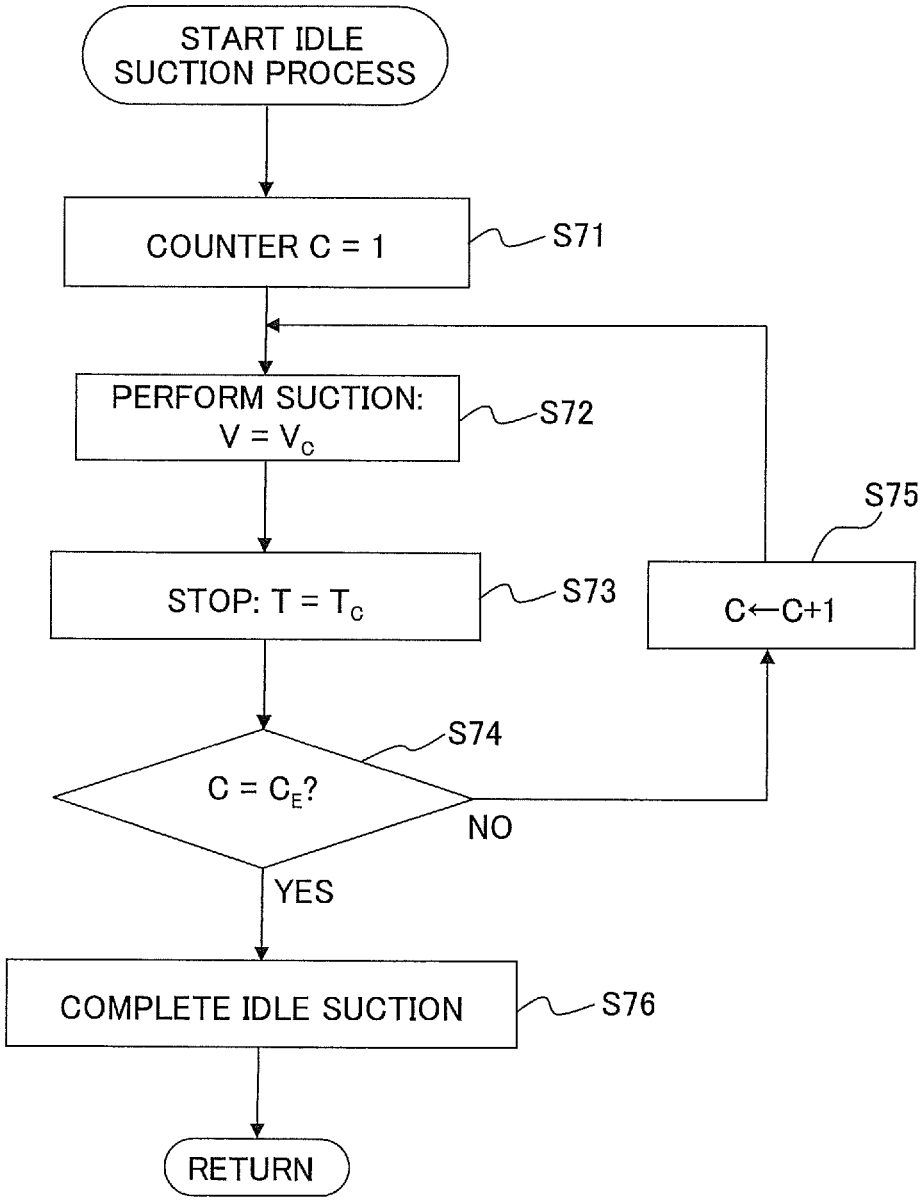

An idle suction process shown in FIG. 6C resides in an embodiment provided by combining the process shown in FIG. 6A and the process shown in FIG. 6B. Specifically, the idle suction process is started to set the counter to the initial value C=1 (Step S71), and then the suction operation (Step S72) and the stopped state (Step S73) are repeated a predetermined number of times (Steps S74, S75) to complete the idle suction (Step S76). However, in the suction operation in Step S72, the suction speed V is more lowered as the processes of Steps S72, S73 are repeated. In the stopping process in Step S73, the stopping time T is more prolonged as the processes of Steps S72, S73 are repeated.

In the embodiment of the idle suction operation as described above, the suction speed is lowered and the stopping time after the suction process is prolonged depending on the remaining amount of the ink which is progressively decreased every time when the suction operation and the stopped state are repeated. Therefore, the opening 35 as shown in FIG. 4A is hardly fowled. Further, even when the opening 35 is formed, the opening 35 can be reliably closed during the stopping period provided once every time. Therefore, it is possible to quickly suck and discharge the ink while suppressing the formation of the opening 35 and reliably closing the formed opening 35.

As shown in FIG. 2, the printer apparatus 1 according to the embodiment of the present invention is provided with the temperature sensor 17. Therefore, in the stopping process for the suction pump 16 to be performed as explained above, it is also allowable that the stopping time is determined based on the temperature in the printer apparatus 1 detected by the temperature sensor 17. For example, the viscosity of the ink is more lowered (fluidity is more increased) as the detected temperature in the printer apparatus 1 is more raised. Accordingly, the stopping period may be set to be shorter. On the contrary, the stopping period may be set to be longer as the temperature in the printer apparatus 1 is more lowered.

In this way, when the temperature in the printer apparatus 1 is high, it is possible to quickly suck and discharge the ink without unnecessarily prolong the stopping period. When the temperature in the printer apparatus 1 is low, it is possible to reliably close the opening 35 by securing the long stopping period. The process as described above can be applied to the stopping process in Step S22 shown in FIG. 5A, Step S43 shown in FIG. 5C, Step S53 shown in FIG. 6A, Step S63 shown in FIG. 6B, and Step S73 shown in FIG. 6C having been already explained. In the application to each of the stopping processes, the process for detecting the temperature in the printer apparatus 1 and the process for determining the stopping period may be performed during the execution of the purge process (see Step S2 shown in FIG. 3A). Alternatively, the process for detecting the temperature in the printer apparatus 1 and the process for determining the stopping period may be performed immediately after the start of the idle suction process (Step S4).

Figure 7:
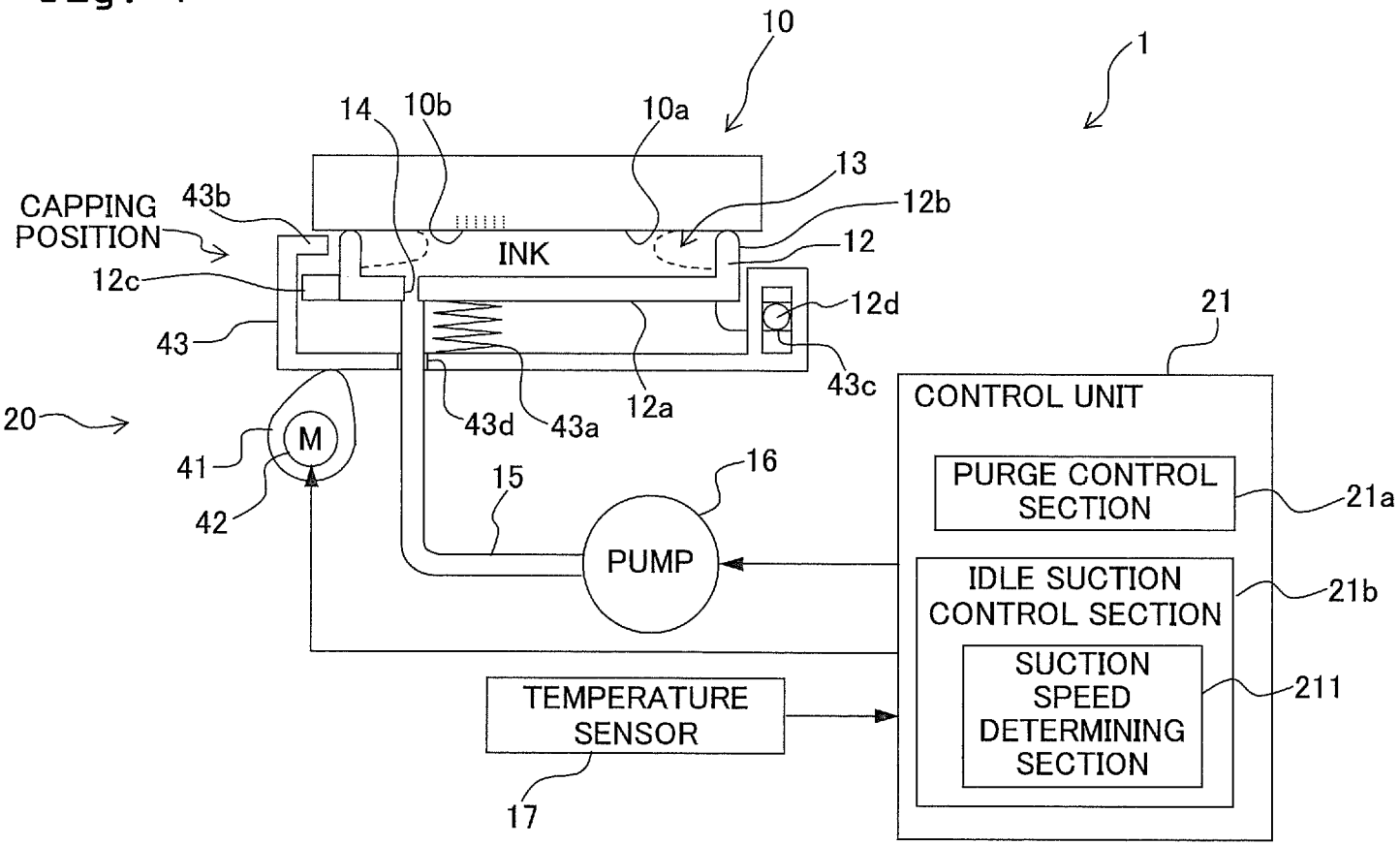
FIG. 7 schematically shows another arrangement applicable to the printer apparatus shown in FIG. 1, which principally illustrates the arrangement in relation to the maintenance.

Next, an explanation will be made about another arrangement applicable to the printer apparatus 1. A printer apparatus 1 shown in FIG. 7 is different from the apparatus constructed as shown in FIG. 2 in relation to the cap 12 and the lifting mechanism (moving mechanism) 20. The other components are the same as or equivalent to those indicated by the same reference numerals shown in FIG. 2. Therefore, the following description will be made about the different constitutive components.

A lifting mechanism 20, which is provided for the printer apparatus 1 shown in FIG. 7, is constructed such that a cap 12 can be released in an inclined posture from the nozzle surface 10*a*. In particular, the lifting mechanism 20 is provided with a cam 41 which has a predetermined profile, an electric motor 42 which is provided as a driving mechanism for driving and rotating the cam 41, and a cap holder 43 which accommodates the cap 12. The cap holder 43 has a box-shaped form which is open at the upper portion. The cap 12 is accommodated in the cap holder 43. A coil spring 43*a*, which is used as a biasing member, is provided on the inner bottom portion of the cap holder 43. The cap 12 is biased upwardly by the coil spring 43*a*.

The cap 12 is provided with a rectangular bottom wall portion 12*a* and a circumferential wall portion 12*b* provided upstandingly on four sides thereof in the same manner as those shown in FIG. 2. In this arrangement, the cap 12 is further provided with a fastening projection 12*c* which is provided to protrude at one end portion of the bottom wall portion 12*a*. The cap holder 43 is provided with a projection shaped or protruding stopper 43*b* which is engageable with the fastening projection 12*c* and which is formed at a portion in the vicinity of one end portion of the cap 12. The stopper 43*b* is provided over or above the fastening projection 12*c*. When the fastening projection 12*c* abuts against the stopper 43*b*, the upper limit position is defined for the cap 12 which is biased by the coil spring 43*a*.

A pivot support shaft 12*d*, which has the axial center in the direction perpendicular to the paper surface direction of FIG. 7, is provided at the other end of the cap 12. A bearing portion 43*c*, which receives the pivot support shaft 12*d*, is provided at the other end of the cap holder 43.

In this way, the cap 12 is movable in the upward direction and the downward direction in the cap holder 43. The pivot support shaft 12*d* supported by the bearing portion 43*c*, and hence one end of the cap 12 is rotatable about the center of the pivot support shaft 12*d*, A discharge hole 14 is formed at a portion disposed in the vicinity of one end portion of the bottom wall portion 12*a* of the cap 12. The suction pump 16 is connected to the discharge hole 14 via a suction tube 15 arranged via a hole 43*d* formed through the bottom wall portion of the cap holder 43.

The circumferential surface of the cam 41, which is disposed at the lower position, abuts against the cap holder 43 which accommodates the cap 12 as described above. The cam 41 is rotated by the driving of the electric motor 42 which is controlled to operate control by the control unit 21. The cap holder 43 (as well as the cap 12) is moved upwardly and downwardly depending on the phase (angle of rotation) of the cam 41. When the cap holder 43 is moved upwardly when the jetting head 10 is at the maintenance position 11 (see FIG. 1), then the cap 12 abuts against the nozzle surface 10*a* of the jetting head 10 to give a state in which the nozzle holes 10*b* are covered therewith as shown in FIG. 7. On the other hand, when the cap holder 43 is moved downwardly, the cam 41 is reversely rotated. Accordingly, the cap holder 43 can be moved downwardly by the self-weight in accordance with the profile of the cam 41.

Figure 8B:
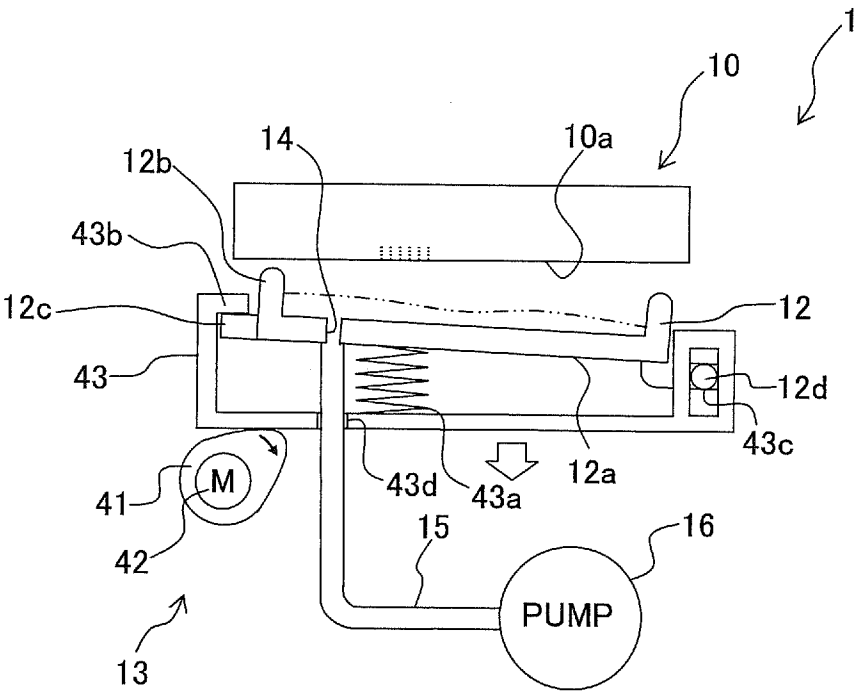
FIG. 8B shows a second separation state in which the cap holder is further moved downwardly.
Figure 8A:
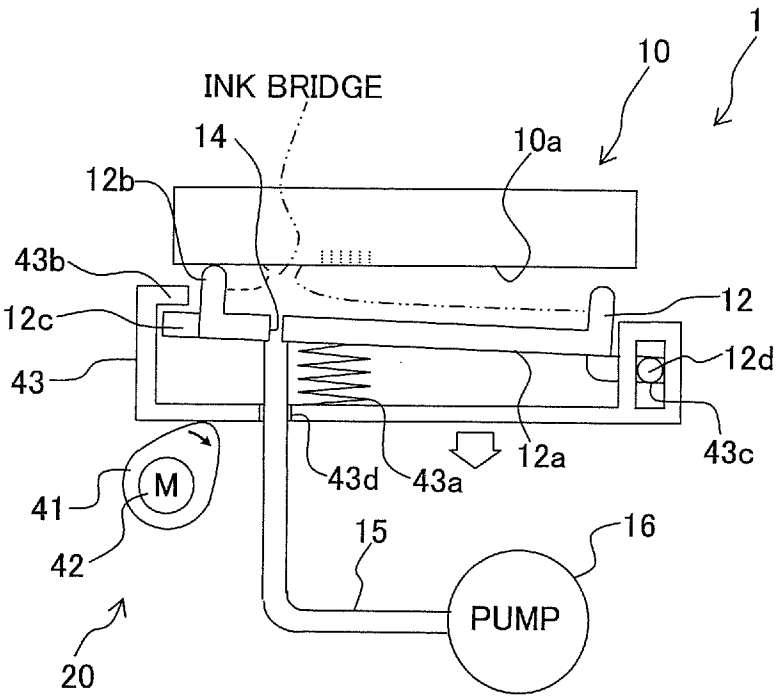
FIG. 8A shows a first separation state in which a cap holder is moved downwardly by a predetermined distance.

As shown in FIG. 8A, when the cam 41 is rotated by a predetermined angle to move the cap holder 43 downwardly, the cap 12 is biased upwardly by the coil spring 43*a*. Therefore, the upper end surface of the circumferential wall portion 12*b*, which is positioned at one end portion of the cap 12, maintains the state of abutment against the nozzle surface 10*a*. On the other hand, as for the other end portion of the cap 12, the pivot support shaft 12*d* is restricted by the bearing portion 43*c*. Therefore, the upper end surface of the circumferential wall portion 12*b*, which is positioned at the other end portion, is separated downwardly from the nozzle surface 10*a*. In this way, in the first separation state, one end portion of the cap 12 is positioned above the other end portion, and the cap 12 is inclined with respect to the nozzle surface 10*a*.

Subsequently, as shown in FIG. 8B, when the cam 41 is further rotated to move the cap holder 43 downwardly, the fastening projection 12*c*, which is on one end side of the cap 12, abuts against the stopper 43*b* at an intermediate position. After that, the cap 12 is moved downwardly together with the cap holder 43, and the second separation state is given, in which the cap 12 is completely separated from the nozzle surface 10*a* while being inclined with respect to the nozzle surface 10*a*.

As described above, the lifting mechanism 20 of the printer apparatus 1 shown in FIG. 7 can move the cap 12 from the state in which the cap 12 abuts against the nozzle surface 10*a* to cover the nozzle holes 10*b* therewith via the first separation state (FIG. 8A) in which the cap 12 is inclined to the second separation state (FIG. 8B) in which the cap 12 is completely separated or isolated from the nozzle surface 10*a*. When the nozzle surface 10*a* is caped by the cap 12, the cam 41 is reversely rotated. Accordingly, it is possible to provide the capping state shown in FIG. 7 from the second separation state via the first separation state.

As shown in FIG. 7, when the purge process is performed in the state that the nozzle surface 10*a* is covered with the cap 12, the ink, which is sucked into the cap 12, is sometimes in such a state that the ink is continuous between the nozzle surface 10*a* and the cap 12 (state in which the ink bridge is formed). If the cap 12 is moved downwardly in this state while maintaining the horizontal posture provided upon the capping, a possibility arises such that a large amount of the ink is still adhered to the nozzle surface 10*a*.

However, in the printer apparatus 1 shown in FIG. 7, the cap 12 is moved downwardly in the inclined posture as shown in FIGS. 8A and 8B, and the cap 12 is separated from the nozzle surface 10*a*. On the other hand, the ink bridge tends to be formed at the portion at which the distance of separation between the cap 12 and the nozzle surface 10*a* is relatively small. Therefore, when the cap 12 is gradually inclined in accordance with the rotation of the cam 41 from the state of the horizontal posture shown in FIG. 7 to the state of the inclined posture shown in FIG. 8A, then the ink bridge is moved in accordance therewith to the portion at which the distance from the nozzle surface 10*a* is small, and the ink bridge is collected in the small area in the vicinity of one end portion of the cap 12. Therefore, as shown in FIG. 8B, it is possible to further decrease the remaining ink on the nozzle surface 10*a* in the second separation state in which the cap 12 is completely separated from the nozzle surface 10*a*.

The idle suction operation, which has been already explained in the various embodiments, can be also executed for the printer apparatus 1 as described above. In the case of the printer apparatus 1, the discharge hole 14, which is formed at the bottom wall portion of the cap 12, is provided in the vicinity of one end portion. Therefore, the discharge hole 14 is positioned in the vicinity of the portion just under the ink bridge in the first separation state shown in FIG. 8A. Therefore, when the suction pump 16 is driven in order to start the idle suction process in this state, the ink, which fowls the ink bridge, is quickly sucked from the discharge hole 14. As a result, it is possible to decrease the amount of the ink remaining on the nozzle surface 10*a*. In the arrangement described above, the cap holder 43 is moved downwardly in accordance with the self-weight depending on the profile of the cam 41. However, another arrangement is also available such that a cam nose portion of the cam 41 and the cap holder 43 are connected to one another by a link mechanism, and the cap holder 43 is moved upwardly and downwardly in cooperation with the rotation of the cam 41 independent from the self-weight.

In the embodiments having been explained above, the discharge hole 14 is formed in the inner bottom portion 12*a* of the cap 12. However, the discharge hole 14 may be formed in a lower part of the circumferential wall portion 12*b*. In this case, in order to prevent the ink from remaining in the liquid storage space 13 of the cap 12, the discharge hole 14 is formed in the lower part of the circumferential wall portion 12*b* so that lower end of the discharge hole 14 and the inner bottom portion 12*a* are the same in height. The inner bottom portion 12*a* and the lower part of the circumferential wall portion 12*b* are included in the bottom portion of the claims.

In the embodiments having been explained above, when the maintenance is executed, the purge process, in which the ink is sucked from the nozzle holes 10*b* to the cap 12, is performed such that the cap 12 is moved to the capping position, the nozzle surface 10*a* of the jetting head 10 is covered with the cap 12, and the suction pump 16 is driven in the predetermined amount at the predetermined speed. However, the maintenance is not limited to the purge process. For example, an actuator (not shown), which is provided for the jetting head 10, may be driven in the state that the nozzle surface 10*a* of the jetting head 10 is covered with the cap 12, and the ink in the jetting head 10 may be discharged from the nozzle holes 10*b* to the cap 12.

The embodiment and the another embodiments of the idle suction process have been explained above as exemplified by the exemplary case in which the suction speed of the suction pump differs between the first and second suction modes in which the suction amounts per the predetermined period of time are different from each other. However, even when the suction speed of the suction pump is constant, it is enough that the suction amount per the predetermined period of time differs. For example, in the first suction mode, the suction may be continuously performed at a constant suction speed, and in the second suction mode, the suction may be intermittently performed while providing an intervening period of time of interruption of the suction while maintaining the constant suction speed. Even in the case of the embodiment of the suction as described above, it is possible to realize the first and second suction modes in which the suction amounts per the predetermined period of time are different from each other.

In the embodiment and the another embodiments of the idle suction process explained above, the suction is continuously performed while maintaining the constant speed of the suction speed of the suction pump 16 in both of the case in which the suction is performed at the high speed and the case in which the suction is performed at the low speed respectively. However, the way of the driving of the suction pump 16 is not limited thereto. For example, the suction may be intermittently performed while providing an intervening period of time of interruption of the suction while maintaining the suction speed to be provided in each of the case in which the suction is performed at the high speed and the case in which the suction is performed at the low speed.

The exemplary embodiments, in which the present invention is applied to the printer apparatus, have been explained above. However, the present invention is not limited to the application to the printer apparatus. The present invention is also applicable to all liquid jetting apparatuses for discharging any liquid other than the ink.

What is claimed is:

1. A maintenance method for a liquid jetting apparatus provided with a jetting head which has a nozzle surface formed with nozzle holes and which jets a liquid from the nozzle holes, and a cap which covers the nozzle surface, the maintenance method comprising:

discharging the liquid in the jetting head from the nozzle holes into the cap in a state that the nozzle surface of the jetting head is covered with the cap; and sucking the liquid discharged into the cap via a discharge hole provided at a bottom portion of the cap in a state that the cap is separated from the jetting head so that the liquid, which is discharged into the cap, is sucked in a first suction mode, and then sucked in a second suction mode in which a suction amount for sucking the liquid in the cap per a predetermined period of time is different from that in the first suction mode.

2. The maintenance method according to claim 1, wherein the liquid in the jetting head is discharged into the cap by sucking the liquid from the nozzle holes in the state that the nozzle surface of the jetting head is covered with the cap.

3. The maintenance method according to claim 1, wherein a suction speed in the second suction mode is lower than a suction speed in the first suction mode.

4. The maintenance method according to claim 3, wherein the suction speed in the second suction mode is substantially zero.

5. The maintenance method according to claim 1, wherein the liquid discharged into the cap is continuously sucked at a predetermined speed in the first suction mode, and is intermittently sucked at the predetermined speed in the second suction mode.

6. A liquid jetting apparatus which jets a liquid, comprising:

a jetting head which has a nozzle surface formed with a plurality of nozzle holes and which jets the liquid from the nozzle holes;

a cap which has a bottom portion formed with a discharge hole and which covers the nozzle surface of the jetting head;

a sucking mechanism which sucks the liquid in the cap via the discharge hole;

a moving mechanism which moves the cap between a capping position at which the cap covers the nozzle holes and a retracted position at which the cap is separated from the jetting head; and a controller which controls the jetting head, the sucking mechanism, and the moving mechanism, wherein the controller controls the moving mechanism to move the cap to the capping position;

controls one of the jetting head and the sucking mechanism to discharge the liquid in the jetting head from the nozzle holes into the cap which is moved to the capping position;

controls the moving mechanism to move the cap from the capping position to the retracted position; and controls the sucking mechanism to suck the liquid discharged into the cap via the discharge hole in a state that the cap is moved to the retracted position; and the controller, when the cap is in the retracted position, drives the sucking mechanism in a first suction mode, and then the controller drives the sucking mechanism in a second suction mode in which a suction amount for sucking the liquid in the cap per a predetermined period of time is different from that in the first suction mode.

7. The liquid jetting apparatus according to claim 6, wherein the controller controls the moving mechanism to move the cap to the capping position, and then the controller controls the sucking mechanism to discharge the liquid in the jetting head from the nozzle holes into the cap.

8. The liquid jetting apparatus according to claim 7, wherein the controller performs driving of the sucking mechanism at a first suction speed when the sucking mechanism is driven in the first suction mode, and the controller performs driving of the sucking mechanism at a second suction speed which is different from the first suction speed when the sucking mechanism is driven in the second suction mode.

9. The liquid jetting apparatus according to claim 7, wherein the controller drives the sucking mechanism continuously in the first suction mode, and the controller drives the sucking mechanism intermittently in the second suction mode.

10. The liquid jetting apparatus according to claim 8, wherein the second suction speed is lower than the first suction speed.

11. The liquid jetting apparatus according to claim 10, wherein when the liquid in the cap is sucked, the controller controls the sucking mechanism to repeat a combination of the driving at the first suction speed and the driving at the second suction speed a plurality of times.

12. The liquid jetting apparatus according to claim 11, wherein the second suction speed is substantially zero.

13. The liquid jetting apparatus according to claim 12, wherein the controller lowers the first suction speed as a number of times of the repetition of the combination is increased.

14. The liquid jetting apparatus according to claim 12, wherein the controller prolongs a driving time of the sucking mechanism at the second suction speed as a number of times of the repetition of the combination is more increased.

15. The liquid jetting apparatus according to claim 10, wherein the controller performs control so that the suction speed of the sucking mechanism for sucking the liquid in the cap is substantially zero between the driving at the first suction speed and the driving at the second suction speed.

16. The liquid jetting apparatus according to claim 12, further comprising a temperature sensor which detects a temperature in the liquid jetting apparatus, wherein the controller changes a driving time of the sucking mechanism at the second suction speed depending on the temperature detected by the temperature sensor.

17. The liquid jetting apparatus according to claim 16, wherein the controller shortens the driving time of the sucking mechanism at the second suction speed as the temperature detected by the temperature sensor is higher.

18. The liquid jetting apparatus according to claim 10, wherein the discharge hole is formed in the vicinity of one end portion of the cap;

the moving mechanism is capable of inclining the cap with respect to the nozzle surface so that a distance between the cap and the nozzle surface at the one end portion is smaller than a distance between the cap and the nozzle surface at the other end portion of the cap; and the controller controls the sucking mechanism to suck the liquid in the cap in a state that the cap is inclined with respect to the nozzle surface.

19. The liquid jetting apparatus according to claim 10, wherein a first period of time for the first suction mode is shorter than a second period of time for the second suction mode.

20. The maintenance method according to claim 3, wherein a first period of time for the first suction mode is shorter than a second period of time for the second suction mode.

* * * * *